US006674975B2

(12) United States Patent
Yamauchi

(10) Patent No.: US 6,674,975 B2
(45) Date of Patent: Jan. 6, 2004

(54) ELECTROPHOTOGRAPHIC IMAGE FORMING APPARATUS AND PROCESS CARTRIDGE

(75) Inventor: Kazumi Yamauchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/951,432

(22) Filed: Sep. 14, 2001

(65) Prior Publication Data

US 2002/0057916 A1 May 16, 2002

(30) Foreign Application Priority Data

Sep. 18, 2000 (JP) ..... 2000-282246

(51) Int. Cl.[7] ..... G03G 15/00

(52) U.S. Cl. ..... 399/12; 399/50; 399/53; 399/66

(58) Field of Search ..... 399/12, 13, 24, 399/25, 26, 36, 37, 39, 45, 50, 66, 111, 53

(56) References Cited

U.S. PATENT DOCUMENTS

| | | | | | |
|---|---|---|---|---|---|
| 4,751,484 | A | * | 6/1988 | Matsumoto et al. | 399/25 |
| 5,250,999 | A | * | 10/1993 | Kimura et al. | 399/39 |
| 5,272,503 | A | | 12/1993 | LeSueur et al. | 399/25 |
| 5,596,388 | A | * | 1/1997 | Ohkubo et al. | 399/111 |
| 5,802,419 | A | * | 9/1998 | Sakurai et al. | 399/26 |
| 5,822,646 | A | * | 10/1998 | Kinoshita et al. | 399/24 |
| 5,937,239 | A | * | 8/1999 | Watanabe et al. | 399/25 X |
| 5,991,557 | A | * | 11/1999 | Kunishi et al. | 399/45 |

* cited by examiner

*Primary Examiner*—Hoan Tran
(74) *Attorney, Agent, or Firm*—Fitzpatrick, Cella, Harper & Scinto

(57) ABSTRACT

During the changeover of image resolution to 600 dpi and 1200 dpi, potential setting is controlled in conformity with the individual information of a process cartridge and the used amount of a photosensitive drum. The individual information is information regarding the manufacturing lots or the kinds of the process cartridge, a developer, the photosensitive drum, a charging roller for acting on the photosensitive drum, a developing apparatus, a cleaning apparatus, and a functional member of the charging roller.

35 Claims, 9 Drawing Sheets

ELECTROPHOTOGRAPHIC IMAGE FORMING APPARATUS AND PROCESS CARTRIDGE

BACKGROUND OF THE INVENTION

1. Field of the Invention

This invention relates to an image forming apparatus using the electrophotographic process such as a laser beam printer, a copier or a facsimile apparatus, and a process cartridge mounted on the image forming apparatus.

Here, the process cartridge refers to at least one of charging means, developing means and cleaning means and an electrophotographic photosensitive body integrally made into a cartridge which is detachably attachable to the main body of an electrophotographic image forming apparatus, or at least developing means and an electrophotographic photosensitive body integrally made into a cartridge which is detachably attachable to the main body of an electrophotographic image forming apparatus.

2. Related Background Art

In an image forming apparatus of the electrophotographic type such as a copier or a laser beam printer, light corresponding to image information is applied to an electrophotographic photosensitive body to thereby form an electrostatic latent image thereon, and a developer (toner) which is a recording agent is supplied to this electrostatic latent image by developing means to thereby visualize the latent image, and further the image is transferred from the electrophotographic photosensitive body to a recording medium such as recording paper to thereby form an image on the recording paper.

In such an image forming apparatus, with a view to achieve the simplicity of the interchange maintenance of expendables such as the electrophotographic photosensitive body and the toner, a toner containing portion, the developing means, the electrophotographic photosensitive body, charging means, cleaning means including a waste toner container, etc. are often made integral as a process cartridge which is made detachably attachable to the main body of the image forming apparatus.

Also, there is an apparatus like a color image forming apparatus which has developing means of a plurality of colors and in which, in order to cope with a case where the degrees of consumption of the respective developing means differ from one another or a case where the degree of consumption of the electrophotographic photosensitive body and the degrees of consumption of the developing means differ from each other, individual means are made into cartridges such as respective color developing cartridges, i.e., developing apparatuses made into cartridges, and a photosensitive body cartridge into which cleaning means and the electrophotographic photosensitive body are integrally made.

There is also an apparatus in which storing means (memories) are carried on these cartridges to thereby control cartridge information. As described in U.S. Pat. No. 5,272,503, there is also an apparatus in which the used amount of a cartridge is stored to thereby change various process conditions. For example, the charging current value is changed over or the exposure amount is adjusted. In these apparatuses, if in spite of the cartridges differing from one another, the used amounts thereof are the same the same control is done.

However, if the image forming apparatus becomes complicated, there will more or less come out the instability of the manufacturing lot, color difference, etc. of the electrophotographic photosensitive body and toners and the difference in characteristic due to the manufacturing lots of individual cartridges. Also, the characteristic is varied by a user's using state and images cannot be always outputted with the same quality. Also, according to the prior art, it has been insufficient to correct any variation in the quality of image in all cartridges.

SUMMARY OF THE INVENTION

Accordingly, it is an object of the present invention to provide an electrophotographic image forming apparatus and a process cartridge which can obtain images of a stable quality of image in conformity with the individual characteristic of the process cartridge by a simple and inexpensive construction.

It is another object of the present invention to provide an electrophotographic image forming apparatus and a process cartridge which can calculate the used amount of the process cartridge by obtaining the individual characterics of the process cartridge from the individual characteristic information of the process cartridge stored in storing means and the history information thereof accumulated with use, and obtain stable images of a high quality conforming to individual characteristics of the process cartridge.

In order to achieve the above objects, the image forming apparatus according to the present invention is an electrophotographic image forming apparatus permitting a process cartridge to be mounted thereon and for forming an image on a recording medium, comprising:

(a) a mounting means for detachably mounting a process cartridge having an electrophotographic photosensitive body, a process means for acting on the electrophotographic photosensitive body, and a storing means for storing the history information of the electrophotographic photosensitive body therein;

(b) a driving means for moving the surface of the electrophotographic photosensitive body;

(c) a charging voltage power supply for applying a voltage to charging means for uniformly charging the surface of the electrophotographic photosensitive body; and (d) a transferring voltage power supply for applying a voltage to a transferring means for transferring an image formed on the electrophotographic photosensitive body by the process means to the recording medium;

(e) a reading means for reading out the history information stored in the storing means;

(f) a detecting means for detecting use information of the electrophotographic photosensitive body in the main body of the electrophotographic image forming apparatus subsequent to the time period of the stored history information;

(g) a calculating means for calculating the latest history information from the stored history information and the use information;

(h) a writing means for writing the latest history information into the storing means; and (i) a control means for changing image forming process conditions on the basis of the history information in the storing means.

According to an embodiment of the present invention, the storing means has individual information regarding the manufacturing lots or kinds of at least one of the process cartridge, a developer, the electrophotographic photosensitive body, the process means for acting on the electrophotographic photosensitive body, and functional members included in the process means.

According to another embodiment of the present invention, the electrophotographic image forming apparatus has a calculation means for calculating the frequency of use of the electrophotographic photosensitive body on the basis of the history information of the electrophotographic photosensitive body and the individual information of the process cartridge stored in the storing means, and a control means for changing the image forming process conditions according to the calculated frequency of use of the electrophotographic photosensitive body.

According to another embodiment of the present invention, the electrophotographic image forming apparatus has a calculation means for calculating the frequency in use of the electrophotographic photosensitive body, and a control means for changing the image forming process conditions on the basis of the calculated frequency in use of the electrophotographic photosensitive body and the individual information of the process cartridge.

According to another embodiment, the electrophotographic image forming apparatus has a conversion expression or a conversion table for converting each bit of individual information of the process cartridge into the frequency in use of the electrophotographic photosensitive body and image forming process conditions conforming to the used amount.

According to another embodiment, the process cartridge comprising a cartridge in which at least one of a charging means, a developing means and a cleaning means as the process means and the electrophotographic photosensitive body are put together and the cartridge is made detachably attachable to the main body of the electrophotographic image forming apparatus.

Another image forming apparatus according to the present invention is an electrophotographic image forming apparatus for forming an image on a recording medium, characterized by:

an electrophotographic photosensitive body;

a process means for acting on the electrophotographic photosensitive body;

a storing means for storing the history information of the electrophotographic photosensitive body therein;

a driving means for moving the surface of the electrophotographic photosensitive body;

a charging voltage power supply for applying a voltage to a charging means for uniformly charging the surface of the electrophotographic photosensitive body;

a transferring voltage power supply for applying a voltage to a transferring means for transferring an image formed on the electrophotographic photosensitive body by the process means to the recording medium;

a reading means for reading out the history information stored in the storing means;

a detecting means for detecting the use information of the electrophotographic photosensitive body in the main body of the image forming apparatus subsequent to the time period of the stored history information;

a calculating means for calculating the latest history information from the stored history information and the use information;

a writing means for writing the latest history information into the storing means; and a control means for changing image forming process conditions on the basis of the history information in the storing means.

According to an embodiment of each of the above-described inventions, the electrophotographic image forming apparatus further has changing means for changing the surface moving speed of the electrophotographic photosensitive body into a surface speed of a plurality of stages when image formation is effected.

According to another embodiment of each of the above-described inventions, the electrophotographic image forming apparatus further comprises a changing means for changing the charging voltage into a charging voltage of a plurality of stages when an image is formed.

According to another embodiment, the electrophotographic image forming apparatus further comprises a changing means for changing a transferring voltage into a transferring voltage of a plurality of stages when an image is formed.

According to another embodiment, the history information stored in the storing means in the electrophotographic image forming apparatus is at least one of a total driving time of the electrophotographic photosensitive body, a total charging time applied to the electrophotographic photosensitive body, and a total transferring time applied to the electrophotographic photosensitive body.

According to another embodiment, the history information stored in the storing means is at least one of a driving time of the electrophotographic photosensitive body at each changed surface moving speed, a charging time under each changed charging voltage condition, and a transferring time under each changed transferring voltage condition.

According to another embodiment, the electrophotographic image forming apparatus comprises a calculation means for calculating frequency in use of the electrophotographic photosensitive body from the history information of the electrophotographic photosensitive body stored in the storing means, and control means for changing image forming process conditions according to the calculated frequency in use of the electrophotographic photosensitive body.

According to another embodiment, the electrophotographic image forming apparatus has a means for calculating the frequency T in use of the electrophotographic photosensitive body on the basis of a calculation expression that $$T=k1\times t1+k2+t2+k3\times t3+k1'\times t1'+k2'\times t2'+\ldots+\alpha$$

(where k1, k1', . . . k2, k2', . . . , k3, k3', . . . ≧0) by the use of predetermined coefficients k1, k1', k1", . . . , k2, k2', k2", . . . , k3, k3', k3", . . . , α when the driving times of the electrophotographic photosensitive body at respective surface moving speeds which are the history information in the storing means are defined as t1, t1', t1", . . . , and the charging voltage applying times under respective charging voltage conditions are defined as t2, t2', t2", . . . , and the transferring voltage applying times under respective transferring voltage conditions are defined as t3, t3', t3", . . . .

According to another embodiment, the electrophotographic image forming apparatus uses a conversion expression or a conversion table for converting the frequency in use of the electrophotographic photosensitive body into image forming process conditions conforming to the used amount.

A process cartridge according to the present invention is a process cartridge detachably attachable to the main body of an electrophotographic image forming apparatus, comprising an electrophotographic photosensitive body, a process means for acting on the electrophotographic photosensitive body, and a storing means for storing the history information of the electrophotographic photosensitive body therein, wherein at least one of a charging means, a developing means or a cleaning means as the process means and the electrophotographic photosensitive body are put into a cartridge together.

According to an embodiment of the present invention, the storing means has at least individual information regarding manufacturing lots or kinds of at least one of the process cartridge, a developer, the electrophotographic photosensitive body, the process means for acting on the electrophotographic photosensitive body, and a functional member included is the process means.

According to another embodiment, the history information stored in the storing means of the process cartridge is at least one of a total driving time of the electrophotographic photosensitive body, a total charging time applied to the electrophotographic photosensitive body, and a total transferring time applied to the electrophotographic photosensitive body.

According to another embodiment, the history information stored in the storing means of the process cartridge is at least one of a driving time of the electrophotographic photosensitive body at each changed surface moving speed, a charging time under each changed charging voltage condition, and a transferring time under each changed transferring voltage condition.

According to another embodiment, the storing means of the process cartridge stores therein a calculation expression for calculating the frequency in use of the electrophotographic photosensitive body conforming to the individual information from the history information of the electrophotographic photosensitive body.

According to another embodiment, the storing means stores therein a conversion expression or a conversion table for converting the frequency in use of the electrophotographic photosensitive body into image forming process conditions conforming to the used amount.

According to another embodiment, the storing means of the process cartridge stores therein a conversion expression or a conversion table for converting the frequency in use of the electrophotographic photosensitive body into image forming process conditions conforming to the individual information and the frequency.

According to another embodiment, the storing means of the process cartridge stored therein at least one of coefficients k1, k1', . . . , k2, k2', . . . , k3, k3', . . . , α when frequency T in use of the electrophotographic photosensitive body is calculated on the basis of a calculation expression that $$T=k1\times t1+k2\times t2+k3\times t3+k1'\times t1'+k2'\times t2'+\ldots\alpha$$

(where k1, k1', . . . , k2, k2', . . . , k3, k3', . . . ≧0) by the use of predetermined coefficients k1, k1', k1", . . . , k2, k2', k2", . . . ,k3, k3',k3", . . . , α when the driving times of the electrophotographic photosensitive body at respective surface moving speeds which are the history information the storing means of the process cartridge has therein are defined as t1, t1', t1", and the charging voltage applying times under respective charging voltage conditions are defined as t2, t2', t2", . . . , and the transferring voltage applying times under respective transferring voltage conditions are defined as t3, t3', t3", . . . .

According to another embodiment, the storing means of the process cartridge stores therein the frequency T in use of the electrophotographic photosensitive body.

The electrophotographic image forming apparatus and process cartridge of the present invention have a reading means for reading out the history information stored in the storing means of the process cartridge, detecting means for detecting the subsequent use information of the electrophotographic photosensitive body in the main body of the image forming apparatus from the stored history information, a calculating means for calculating the latest history information from the stored history information and the use information, a writing means for writing the latest history information into the storing means, and a control means for changing the image forming process conditions on the basis of the history information in the storing means, and thereby can effect the proper control of the process conditions by the use situation of the electrophotographic photosensitive body in conformity with the characteristics of individual process cartridges, and accordingly can obtain stable images of a high quality. Further, they can calculate the used amount of the process cartridge having absorbed the individual difference of the process cartridge thereinto by the individual information of the process cartridge stored in the storing means, and the history information accumulated with the use, and can obtain stable images of a high quality in conformity with individual characteristics.

Other objects and aspects of the invention will become apparent from the following description of embodiments with reference to the accompanying drawings.

DESCRIPTION OF THE PREFERRED EMBODIMENTS

An electrophotographic image forming apparatus and a process cartridge according to the present invention will hereinafter be described in greater detail with reference to the drawings.

Embodiment 1

Reference is first had to FIGS. 1 to 7 to describe an embodiment of an electrophotographic image forming apparatus on which a process cartridge constructed in accordance with the present invention is mountable.

Figure 1:
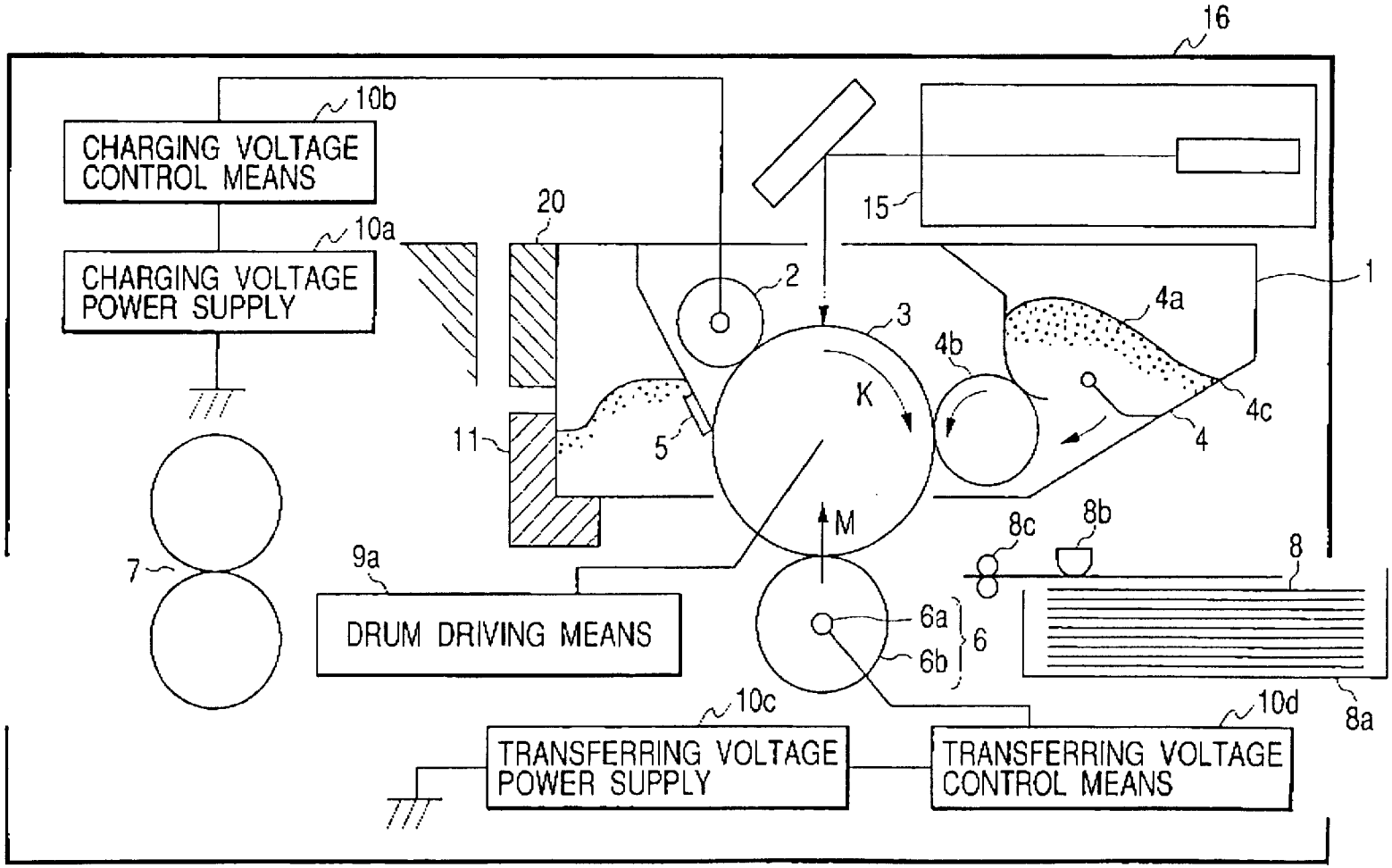
FIG. 1 shows the construction of an embodiment of an image forming apparatus according to the present invention.

FIG. 1 shows a printer (LBP) effecting exposure by the use of a laser beam which is the image forming apparatus of the present embodiment. The printer of the present embodiment is of a construction in which it can be operated to print with image resolution changed over to 600 dpi and 1200 dpi in order to meet the user's requirement.

Also, as shown, in the image forming apparatus, a laser beam modulated in conformity with an image signal is outputted from a scanner unit 15 and is applied to a photosensitive drum 3 which is an electrophotographic photosensitive body. The photosensitive drum 3 is uniformly charged in advance by a charging roller 2 which is charging means, and an electrostatic latent image is formed thereon in conformity with the application of the laser beam.

On the other hand, a developer (toner) 4*a* contained in the toner container 4*c* of a developing apparatus 4 is carried while the peripheral surface of a developing roller 4*b* is charged, and a toner layer capable of developing is formed on the developing roller 4*b*. The electrostatic latent image is developed by the toner layer and is visualized as a toner image.

On the other hand, a recording material 8 which is a recording medium contained in a cassette 8*a* is supplied by a feed roller 8*b* in synchronism with the latent image formation on the photosensitive drum 3. This recording material 8 is conveyed to roller-shaped transferring means 6 through conveying means 8*c* in synchronism with the leading end of the toner image on the photosensitive drum 3, and the toner image is transferred to the recording material 8 by transferring means 6. The recording material 8 to which the toner image has been transferred is conveyed to a fixing device 7, where the toner image is fixed and becomes a permanent image. Any toner residual on the photosensitive drum 3 is removed by cleaning means 5. The main body 16 of the electrophotographic image forming apparatus (hereinafter simply referred to as the main body of the apparatus) is provided with mounting means 11 for detachably mounting the process cartridge 1.

Figure 2:
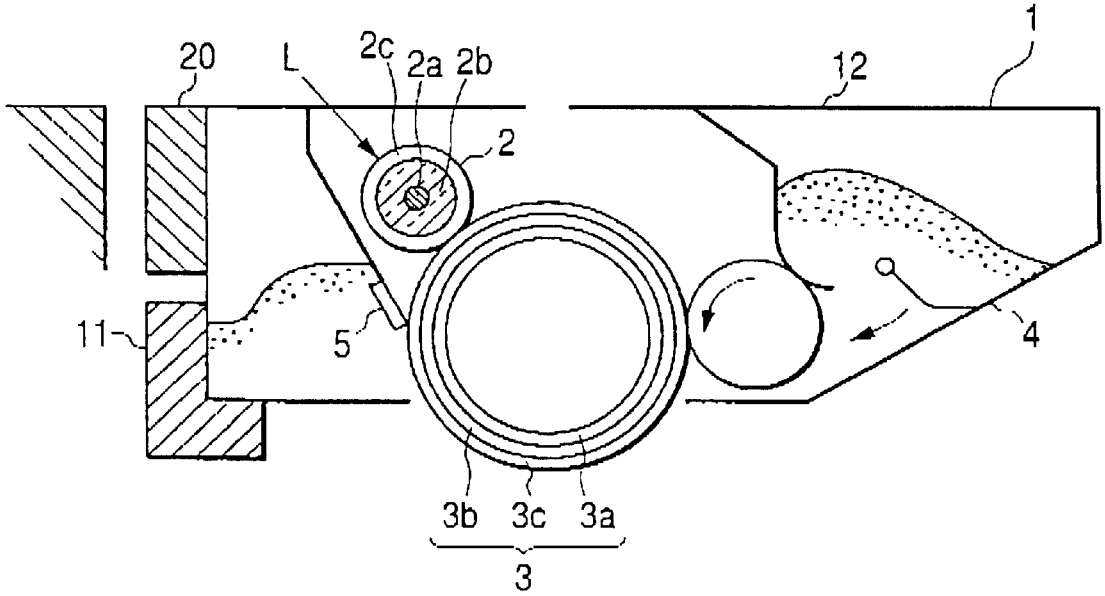
FIG. 2 shows the construction of an embodiment of a process cartridge according to the present invention.

The process cartridge 1 shown in FIGS. 1 and 2 comprises the photosensitive drum 3, the charging roller 2 and the developing apparatus 4 as process means for acting on the photosensitive drum 3, the cleaning means 5 comprising an elastic cleaning blade, and a cover 12 covering these collectively made into a cartridge. These constituent parts including the photosensitive drum 3 are assembled together with the predetermined mutual disposition relation of the process cartridge 1, and the process cartridge 1 can be inserted into and mounted with respect to a predetermined portion (mounting means 11) of the main body a of the apparatus in a predetermined manner, and can be detached from the main body 16 of the apparatus.

Now, the photosensitive drum 3 has an outer diameter of 30 mm, and is comprised of a charge general generating layer 3*b* and a charge transporting layer 3*c* laminated on the surface of an electrically conductive base 3*a* made of aluminum, and is rotatively driven in the arrowed direction K in FIG. 1 at a peripheral speed (surface moving speed) of V1=200 mm/sec. during 600 dpi, and at a peripheral speed of V2=100 mm/sec. during 1200 dpi, by drum driving control means 9*a*. Also, the charging roller 2 is of two-layer structure comprising a sponge layer 2*b* and a surface layer 2*c* wound on a mandrel 2*a*. The mandrel 2*a* has a diameter of 6 mm, the outer diameter of the roller is 12 mm, and the length of the roller is about 220 mm. The opposite ends of the mandrel 2*a* are pressurized with 500 gf (=5W) in the arrowed direction L in FIG. 2, and the charging roller 2 is in contact with the photosensitive drum 3 with a nip of the order of 1.5 mm.

Figure 3:
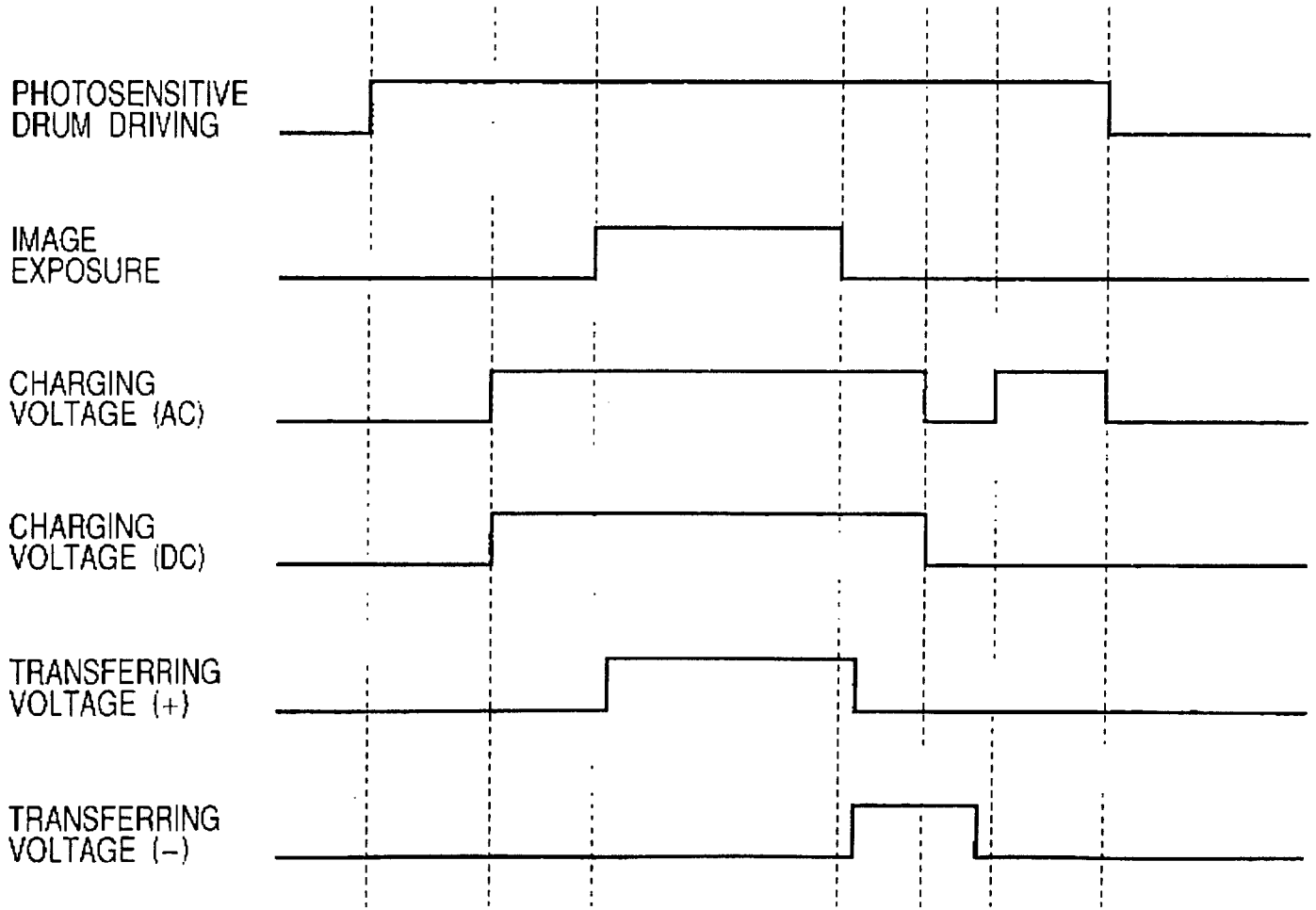
FIG. 3 is a timing chart of image formation according to the present invention.

The charging roller 2 is not driven, but is rotated following the rotation of the photosensitive drum 3, and is connected to a charging voltage applying power supply 10*a* through a charging voltage control means 10*b* and the mandrel 2*a*. As shown in FIG. 3, in the present embodiment, a voltage comprising an AC voltage (peak-to-peak voltage 1600 V, frequency 1500 Hz, sine wave) superimposed upon a DC voltage of −700V is applied as a charging voltage applying condition I in a portion including an image forming area during the printing operation at 600 dpi (the peripheral speed V1 of the photosensitive body), to thereby uniformly charge the surface of the photosensitive body to about −680 V. Also, during the rotation of the photosensitive body, in the other portion, there exists a portion to which only an AC voltage is applied as a charging voltage applying condition II.

Also, during the printing operation at 1200 dpi (the peripheral speed of the photosensitive body being V2), a voltage comprising an AC voltage (peak-to-peak voltage 1600 V, frequency 1000 Hz, sine wave) superimposed upon a DC voltage of −700 V is applied as a charging voltage applying condition III to a portion including the image forming area, to thereby uniformly charge the surface of the photosensitive body to about −680 V. During the printing operation at 600 dpi, during the rotation of the photosensitive body, in the other portions, there exists a portion to which only an AC voltage is applied as the charging voltage applying condition II.

In the present embodiment, the respective charging voltage applying conditions are changed over thus: charging voltage applying conditions I and III: for the purpose of obtaining high charging in the image bearing image; charging voltage applying condition II: for the purpose of using an AC voltage to eliminate the surface potential at the end of printing.

Also, the frequencies of the applied voltages of the charging voltage applying conditions I and III are set so that a moire image (interference fringes due to the laser operation frequency on the drum and the frequency of uneven charging approximating each other) by each image resolution may not come out.

The transferring roller 6 comprises a mandrel 6*a* and a sponge layer 6*b* provided thereon. The mandrel 6*a* has a diameter of 6 mm, and the outer diameter of the roller is 17 mm and the length of the roller is about 220 mm. Also, the opposite ends of the mandrel 6*a* are pressurized with 1000 gf (=10W) in the direction of arrow M, and the transferring roller 6 is rotated following the rotation of the photosensitive drum 3.

Further, the transferring roller 6 is connected to a transferring voltage applying power supply 10*c* through a transferring voltage control means 10*d* and the mandrel 6*a,* and in the present embodiment, during the printing operation at 600 dpi (the peripheral speed of the photosensitive body being V1), a DC voltage of +2.0 kV is applied as a transferring voltage applying condition I to a portion including the image forming area, to thereby transfer the toner image, not shown, on the photosensitive drum 3 to the recording material 8. Also, during the rotation of the photosensitive body, in the other portion, there exists a portion to which −2.0 kV is applied as a transferring voltage applying condition II. Also, during the printing operation at 1200 dpi (the peripheral speed of the photosensitive body being V2), a transferring voltage is applied under a similar condition.

In the present embodiment, the respective transferring voltage applying conditions are changed over thus: transferring voltage applying condition I: for the purpose of transferring the toner in the image bearing area; transferring voltage applying condition II: for the purpose of effecting the cleaning of the transferring roller 6 at the end of printing.

The storing means 20 of the process cartridge 1 is not particularly limited if it is one which rewritably stores and retains signal information therein, and use is made, for example, of electrical storing means such as an nonvolatile RAM or a ROM capable of rewriting, or magnetic storing means such as a magnetic storing bubble memory or a magneto-optical memory.

The storing means 20 stores therein the individual information and history information of the process cartridge 1. The individual information of the process cartridge 1 includes information regarding the manufacturing lot and kind of the photosensitive drum 3, and the history information of the process cartridge 1 includes the total driving time of the photosensitive drum 3 and the total voltage applying time of the charging roller 2, i.e., the total charging time applied to the photosensitive drum 3, and the total voltage applying time of the transferring roller 6, i.e., the total transferring time applied to the photosensitive drum 3. Besides these, any information which can be utilized is not limited, but as the individual information of the process cartridge 1, utilization is made of information regarding the manufacturing lots and kinds of the process cartridge 1, the toner, the process means and the functional members thereof, and as the history information, utilization is made of the total exposure amount of the photosensitive drum 3, etc.

The control of the image forming process conditions in the present embodiment will now be described.

Figure 4:
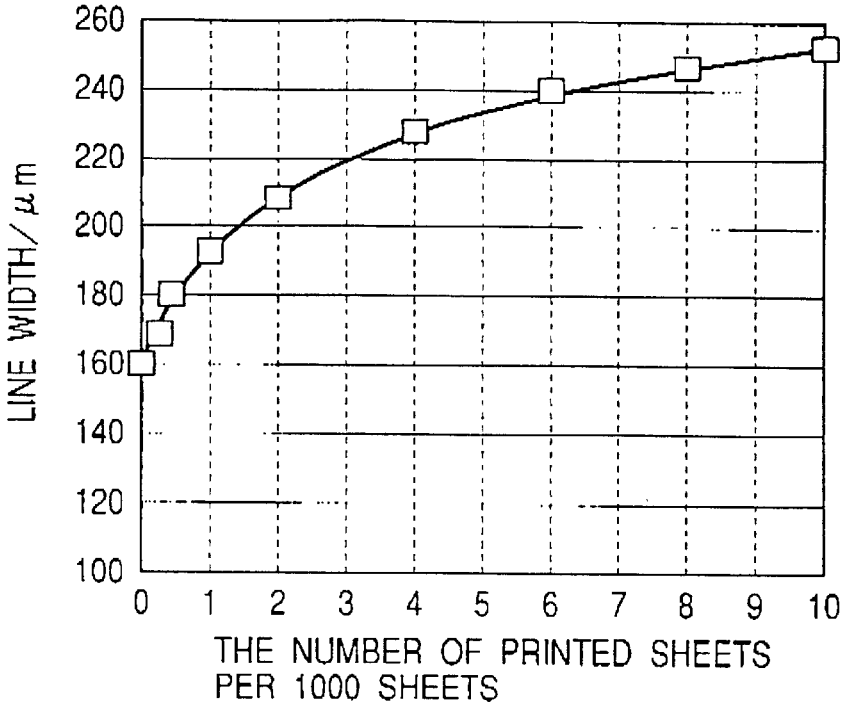
FIG. 4 is a graph showing the endurance transition of a line width.

FIG. 4 shows the endurance transition of 4 DOT line width (600 dpi). It is known that as shown, the line width tends to become thick as printing progresses from the initial state of the process cartridge 1.

Figure 5:
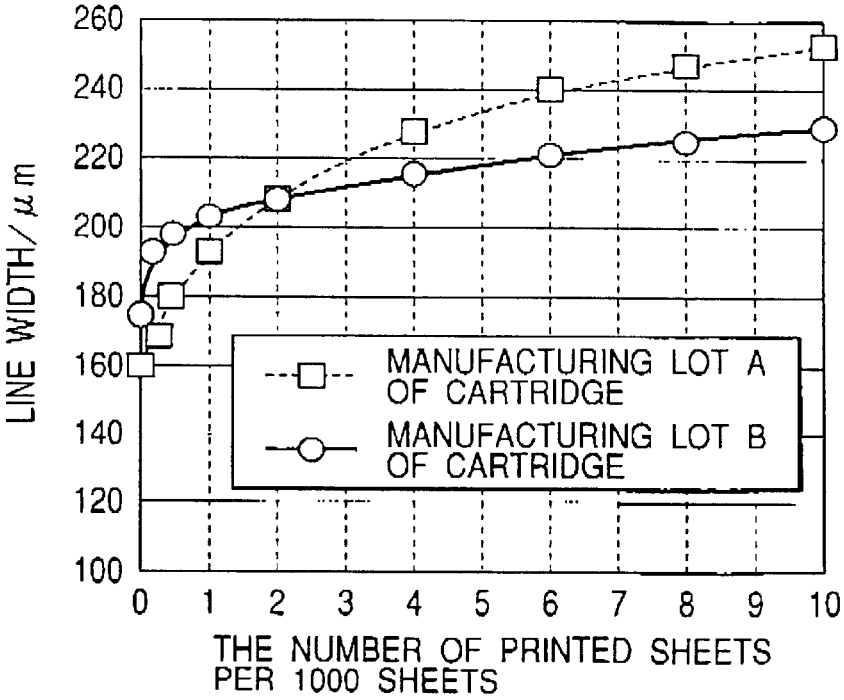
FIG. 5 is a graph showing the endurance transitions of a line width differing depending on the manufacturing lot of the cartridge.
Figure 11:
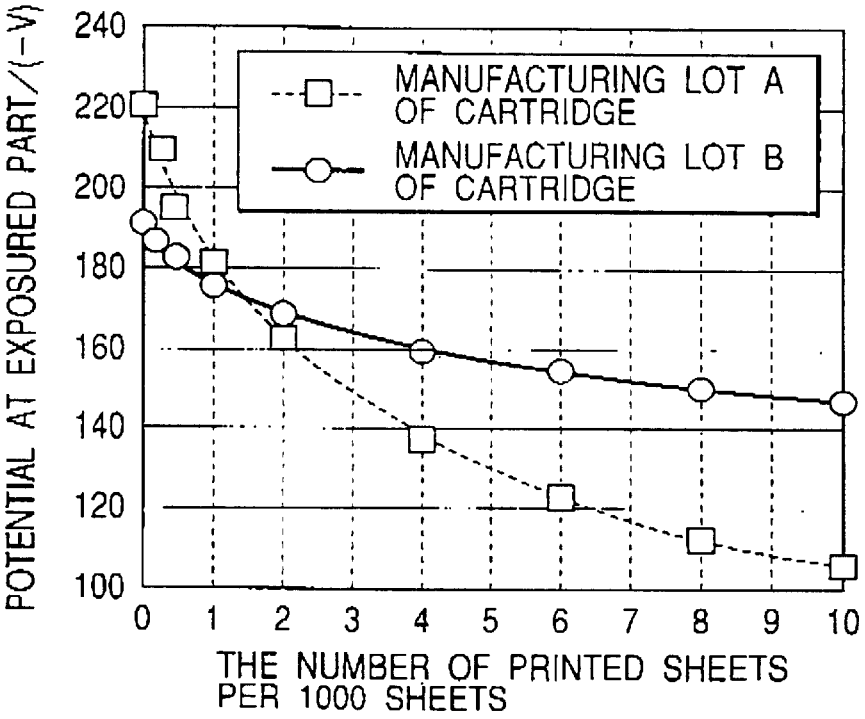
FIG. 11 is a graph showing the endurance transition of VL differing depending on the manufacturing lot of the cartridge.

Various causes are conceivable about this, and mention may be made chiefly of the instability of the charged amount of the toner in the initial state, and the endurance fluctuation of the potential (VL) of the exposed portion of the photosensitive body 3. Particularly the transition of VL is fluctuated by the sheet feeding mode and therefore is the main factor of the endurance fluctuation of the line width. Also, FIGS. 11 and 5 show the endurance transitions of VL and the endurance fluctuations of the line width in two discrete lot cartridges. As shown, the transition of VL differs also depending on the manufacturing lot of the cartridge, i.e., the photosensitive drum 3, and therefore the unevenness of the line width becomes great.

Chiefly two factors may be mentioned as to why the endurance transition of VL differs depending on the manufacturing lot of the photosensitive drum 3. A first factor is that the amount of wear of the photosensitive drum 3 differs depending on the kind and lot of the charge transporting layer of the photosensitive drum 3 and cannot be represented as the same used amount even if the same number of sheets are fed. Another factor is that the generated amount of charges is considered to be fluctuated by the kind and lot of the charge generating layer of the photosensitive drum 3 with a long-period use. Accordingly, it is necessary to calculate a used amount based on the kind and manufacturing lot of the photosensitive drum 3, and control the process conditions for each kind and manufacturing lot of the photosensitive drum 3 in conformity with the used amount.

So, in the present embodiment, the following control is effected:

(1) To provide a memory 20 in the process cartridge 1, and store therein the following individual information differing in the kind and lot of the photosensitive drum 3 during the shipment from the factory:

(a) a coefficient for calculating the used amount of the photosensitive drum 3; and (b) a conversion table for converting the used amount of the photosensitive drum 3 into optimum process conditions;

(2) In the image forming apparatus, for the process cartridge to store in the memory the rotation time, the charging voltage applying time and the transferring voltage applying time which are the history information of the photosensitive body;

(3) In the main body of the image forming apparatus, to calculate the used amount of the photosensitive drum 3 from the calculation coefficient, the rotation time, the charging voltage applying time and the transferring voltage applying time stored in the memory 20 in the process cartridge 1;

(4) To change the weighting of the above item (1) correspondingly to the changeover of the process condition of the image forming apparatus; and (5) To compare the calculated used amount of the photosensitive drum 3 with the conversion table, and change the DC component of the charging voltage and the DC component of the developing voltage when the used amount assumes the table value.

Thereby, the stable transition of the line width can be obtained.

Figure 6:
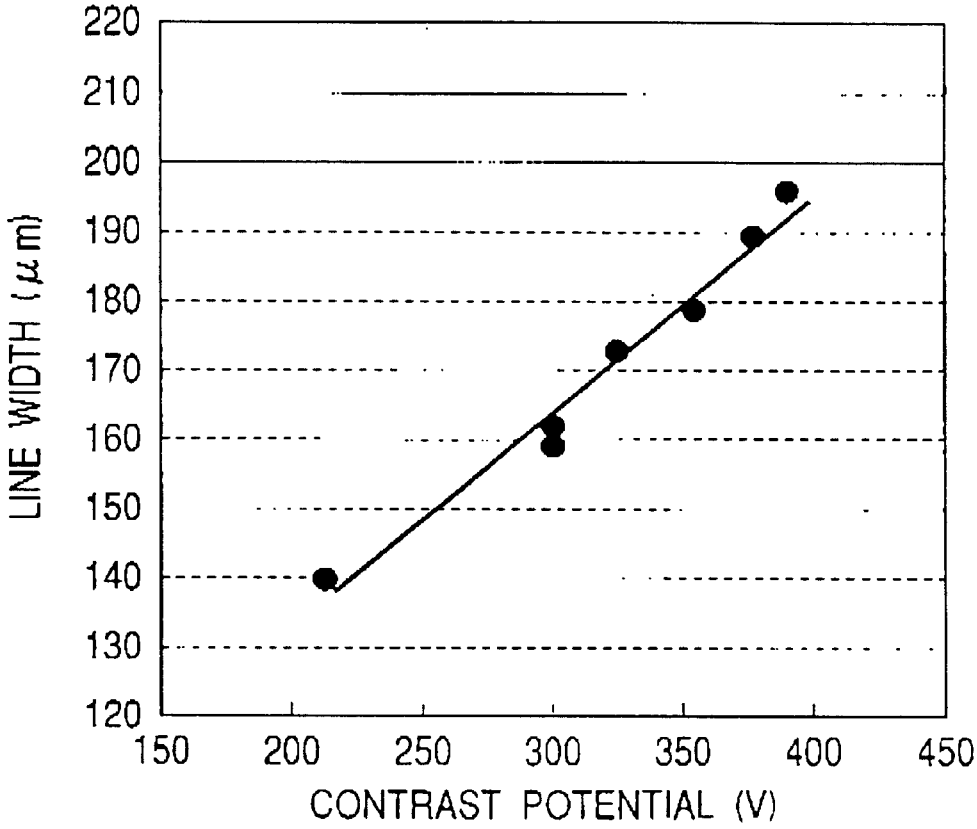
FIG. 6 is a graph representing the relation between the setting of potential and the line width.

Description will be made here about the reason why the line width can be controlled by changing the DC component of the charging voltage and the DC component of the developing voltages, i.e., the potential setting. FIG. 6 shows the relation between the developing contrast potential and the line width. The developing contrast potential represents the absolute value of the potential difference between the DC component of the developing voltage and the VL potential of the drum.

As can be seen from FIG. 6, the two have a good correlation therebetween, and the amount of variation in the line width per 10 V of the DC component of the developing voltage is 2 to 5 ($\mu$m/10V). Accordingly, it will be seen that to correct the line width fluctuated by the individual difference and used state of the cartridge, the developing contrast potential can be controlled.

Description will now be made of a method of calculating the used amount of the photosensitive drum 3.

The used amount T of the photosensitive drum 3 is calculated from the driving time t1, the charging voltage applying time t2 and the transferring voltage applying time t3 of the drum which are the history information of the photosensitive drum 3 by the following calculation expression (1):

$$T=k1\times t1+k2\times t2+k3\times t3+\alpha \quad (1)$$

(k1, k2, k3 and $\alpha$ are constants inherent to the kind and manufacturing lot of the photosensitive drum 3, and are called calculation coefficients.)

Also, in the present embodiment, the surface moving speed, the charging voltage applying condition and the transferring voltage applying condition of the photosensitive drum 3 are changed in a plurality of stages and therefore, as in the following calculation expression (2), the calculation coefficients are set for each condition.

$$T=k1\times t1+k2\times t2+k3\times t3+k1'\times t1'+k2'\times t2'+k3'\times t3'+\ldots\alpha \quad (2)$$

(where k1, k1', . . . , k2, k2', . . . , k3, k3', . . . $\geqq 0$)

Here, regarding k1, k1', . . . , k2, k2', . . . , k3, k3', the values of Table 1 below are used, and the reason for this will be described below.

TABLE 1

| | | charging voltage | | transferring voltage | |
|---|---|---|---|---|---|
| | driving | DC + AC | AC | plus | minus |
| 600 DPI | k1 = 0.3 | k2 = 1.0 | k2" = 0.95 | k3 = 0.45 | k3" = 0.40 |
| 1200 DPI | k1' = 0.25 | k2' = 0.5 | k2"' = 0.48 | k3' = 0.3 | k3"' = 0.275 |

I have examined the contribution of the driving time and the voltage applying times about the used amount of the photosensitive drum 3, and particularly the amount of wear of the photosensitive drum 3, in the respective states in the sequence and as the result, have found that when the amount of wear to the driving time is 1, when the charging AC voltage is applied, the amount of wear is about two to three times, and when the transferring voltage is applied, the amount of wear is about 1 to 1.5 times.

When the charging AC voltage is applied, positive and negative voltages are alternately applied as the applied voltage to thereby repeat discharge and reverse discharge and therefore, the deterioration of the surface of the photosensitive body is great, and the deteriorated surface of the photosensitive body is shaved by the friction thereof with an abutting member such as a cleaning blade. Also in the case of the transferring voltage, some discharge is caused by the applied voltage, but in this case, the recording medium intervenes and therefore, the influence on the deterioration of the surface of the drum is smaller than in the case of the charging AC voltage.

Also, when for the respective voltage applying conditions, the surface moving speed of the photosensitive body is reduced to a half speed, it has been found that when the amount of wear to the driving time is 1, the amount of wear is about 1 to 1.5 times when the charging AC voltage is applied, and the amount of wear is about 1 to 1.3 times when the transferring voltage is applied. Also, when the surface moving speed is reduced to a half speed, the movement distance of the surface of the photosensitive body per unit time is a half and therefore, the frequency with which the surface of the photosensitive body rubs against the cleaning blade or the like becomes smaller and thus, each amount of wear becomes substantially a half.

This result was obtained by examining a system using blade cleaning as the photosensitive body cleaning method by the use of an OPC photosensitive body having a surface layer having polycarbonade as a main binder as the photosensitive body.

Considering from the above-described result of the examination that the used amount of the photosensitive drum 3 is dominantly determined by the damage thereof, the driving time, the charging voltage applying time and the transferring voltage applying time under each condition are multiplied by respective coefficients and the totalled calculated value is defined as the used amount of the photosensitive drum 3, whereby highly accurate process control becomes possible.

Further, $\alpha$ is a constant for correcting some error in calculation expressions (1) and (2) and accordingly, $\alpha$ may be $\alpha=0$.

A control system in the present embodiment will now be described with reference to FIG. 7.

The photosensitive drum 3 has its rotating operation (rotating speed and rotation ON/OFF) controlled by driving control means 9*b* controlling driving means 9*a*. The charging roller 2 which is contact charging means has its AC voltage and DC voltage suitably controlled independently of each other by charging voltage control means 10*b* controlling a charging voltage applying power supply 10*a*. Also, the transferring roller 6 has its plus voltage and minus voltage suitably controlled independently of each other by transferring voltage control means 10*d* controlling a transferring voltage applying power supply 10*c*. Further, the developing roller 4*b* also has its developing bias controlled by developing voltage control means 10*f* controlling a developing voltage applying power 10*e*.

The integrated driving time value t1 of the photosensitive drum 3, the integrated voltage applying time value t2 of the charging roller and the integrated voltage applying time value t3 of the transferring roller are stored in storing areas 20*a* to 20*c*, respectively, in the memory 20 of the process cartridge 1, and the calculation coefficients (k1, k1', . . . , k2, k2', . . . , k3, k3', . . . ) about the photosensitive drum 3 lot and the conversion table about the process cartridge are stored in a storing area 20*d*.

When the main body 16 receives a print signal, the calculation coefficient (individual information) used during the calculation of the used amount of the drum and the conversion table (individual information) of the process conditions are read out from the storing area 20*d* in the memory 20 of the process cartridge 1 by the individual information reading means 21*d* of the main body. Also, the integrated driving time value t1 of the photosensitive drum 3 and the integrated voltage applying time values t2 and t3 (history information) of the charging roller and the transferring roller, respectively, are read out from the storing areas 20*a* to 20*c* by history information reading means 21*a*, 21*b* and 21*c*, respectively. Further, during image formation, the time of the photosensitive drum 3 in the image formation and the charging and transferring voltage applying times are detected by driving time detecting means 23*a*, charging voltage applying time detecting means 23*b* and transferring voltage applying time detecting means 23*c*, respectively, and at the end of the driving of the photosensitive drum 3, the integrated values and the detected values are totalled by integrated driving time value calculating means 24*a*, integrated charging time value calculating means 24*b* and integrated transferring time value calculating means 24*c*, and are stored as the latest history information in the memory 20 by integrated driving time writing means 22*a*, integrated charging voltage applying time writing means 22*b* and integrated transferring voltage applying time writing means 22*c*.

Also, the main body 16 of the image forming apparatus is provided with calculation means 25 for frequency T in use of the photosensitive body connected to a CPU 30.

Figure 7:
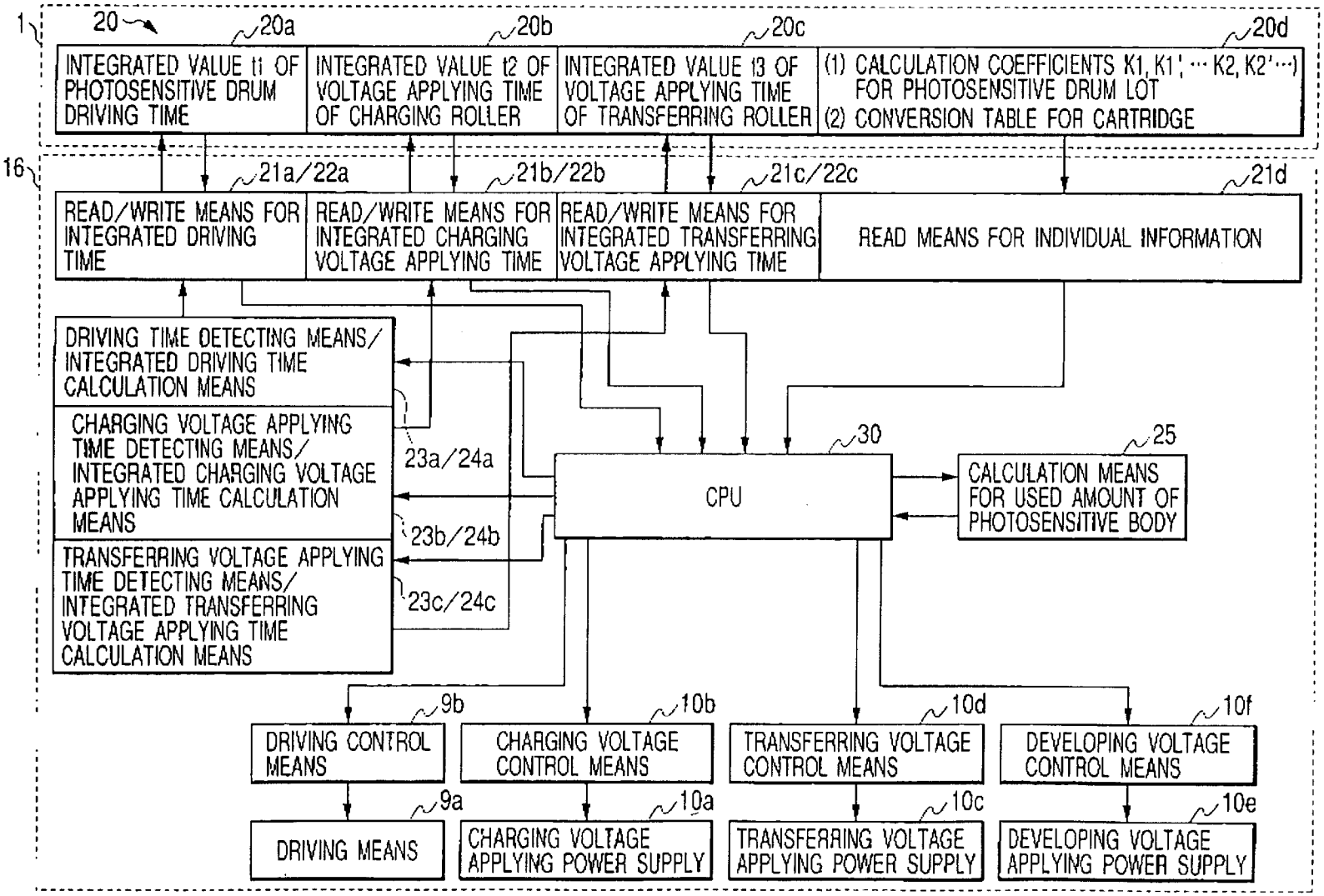
FIG. 7 is a block diagram of elements constituting the characteristic portions of the present invention.

The above-described control is effected through the CPU 30, as is apparent from FIG. 7.

Figure 8:
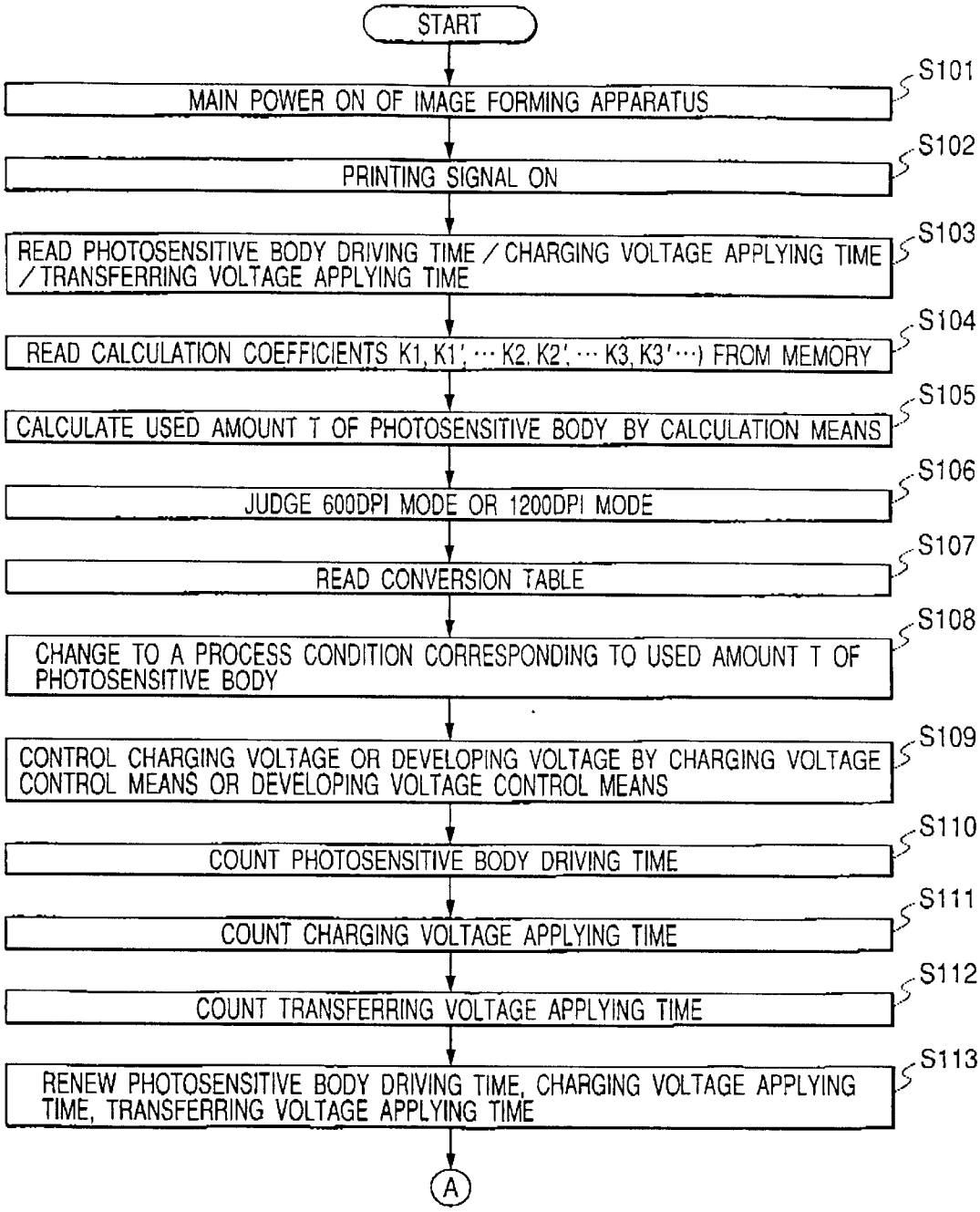
FIG. 8 is a flow chart of the control of potential setting in a first embodiment of the present invention.
Figure 9:
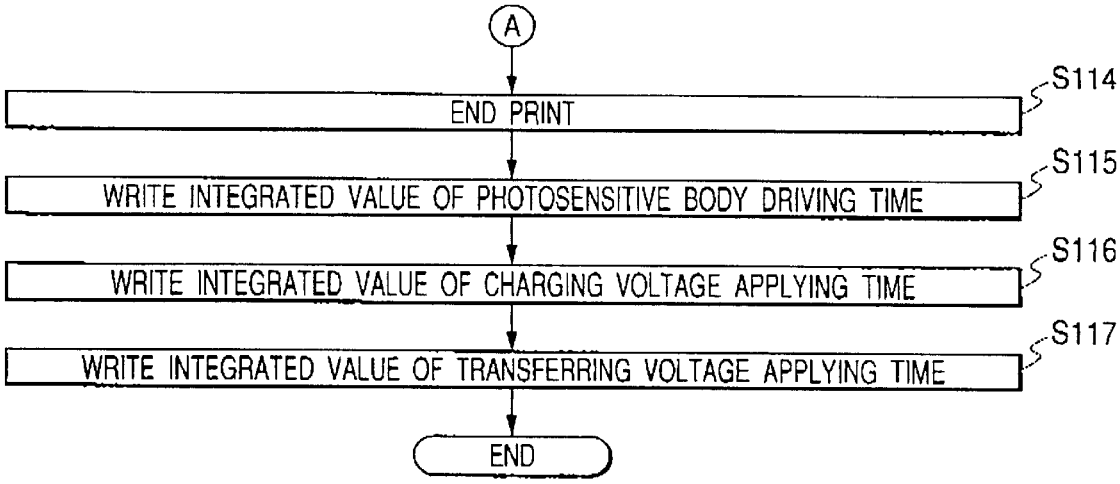
FIG. 9 is a flow chart continued from the control of FIG. 8.

The image forming operation of the present embodiment will now be described with reference to the flow charts of FIGS. 8 and 9.

Start

S101: The power supply of the main body 16 of the image forming apparatus is rendered ON.

S102: A printing signal is ON.

S103: The integrated values t1, t2 and t3 of the photosensitive drum 3 driving time, the charging voltage applying time and the transferring voltage applying time hitherto are read from the memory 20 of the process cartridge 1 into the CPU 30 by the integrated driving time reading means 21*a*, the integrated charging voltage applying time reading means 21*b* and the integrated transferring voltage applying time reading means 21*c*, respectively, of the main body 16 of the apparatus.

values. The developing voltage when process control is not effected comprises an AC voltage (Vpp 1600V, frequency 2.4 kHz) superimposed on a DC voltage −450 V.

TABLE 2

| used amount of drum T (sec) | 0 | 1500 | 4500 | 9000 | 18000 | 35000 | 53000 | 70500 | 88000 |
|---|---|---|---|---|---|---|---|---|---|
| charging DC voltage (V) | 740 | 729.5 | 714.5 | 701 | 683 | 657.5 | 642.5 | 635 | 627 |
| developing DC voltage (V) | 490 | 479.5 | 464.5 | 451 | 433 | 407.5 | 392.5 | 385 | 377 |

S104: The individual information reading means 21*d* reads the calculation coefficients k1, k1', . . . , k2, k2', . . . , k3, k3', . . . from the memory 20 of the process cartridge 1 into the CPU 30.

S105: The frequency T in use of the photosensitive drum 3 is calculated by the calculation means 25.

S106: Whether the mode is 600 DPI mode or 1200 DPI mode is judged.

S107: The individual information reading means 21*d* reads the conversion table for converting the frequency in use of the drum into process conditions from the memory 20 of the process cartridge 1,

S108: Change to a process condition corresponding to the frequency T in use of the photosensitive body.

S109: The charging voltage control means 10*b* and the developing voltage control means 10*e* control the DC component of the charging voltage and the DC component of the developing voltage, respectively, designated by the conversion table.

S110: The photosensitive body driving time detecting means 23*a* starts to count the photosensitive body driving time.

S111: The charging voltage applying time detecting means 23*b* starts to count the charging voltage applying time under each charging condition.

S112: The transferring voltage applying time detecting means 23*c* starts to count the transferring voltage applying time under each transferring condition.

S113: The integrated value calculating means 24*a*, 24*b* and 24*c* renew the photosensitive body driving time, the charging voltage applying time and the transferring voltage applying time, respectively, under each condition.

S114: Printing is ended.

S115: The Integrated value of the renewed photosensitive body driving time is written into the memory 20 of the process cartridge 1 by the integrated driving time writing means 22*a*.

S116: The integrated value of the charging voltage applying time renewed under each condition is written into the memory 20 of the process cartridge 1 by the integrated charging voltage applying time writing means 22*b*.

S117: The integrated value of the transferring voltage applying time renewed under each condition is written into the memory 20 of the process cartridge 1 by the integrated transferring voltage applying time writing means 22*c*.

Table 2 below shows a conversion table used when in the cartridge of the manufacturing lot A, conversion is effected from the used amounts of the photosensitive body Into charging voltage DC values and developing voltage DC Also, the DC component of the charging voltage was operatively associated to make the back contrast constant from the viewpoint of preventing fog when the DC component of the developing voltage was changed.

Figure 10:
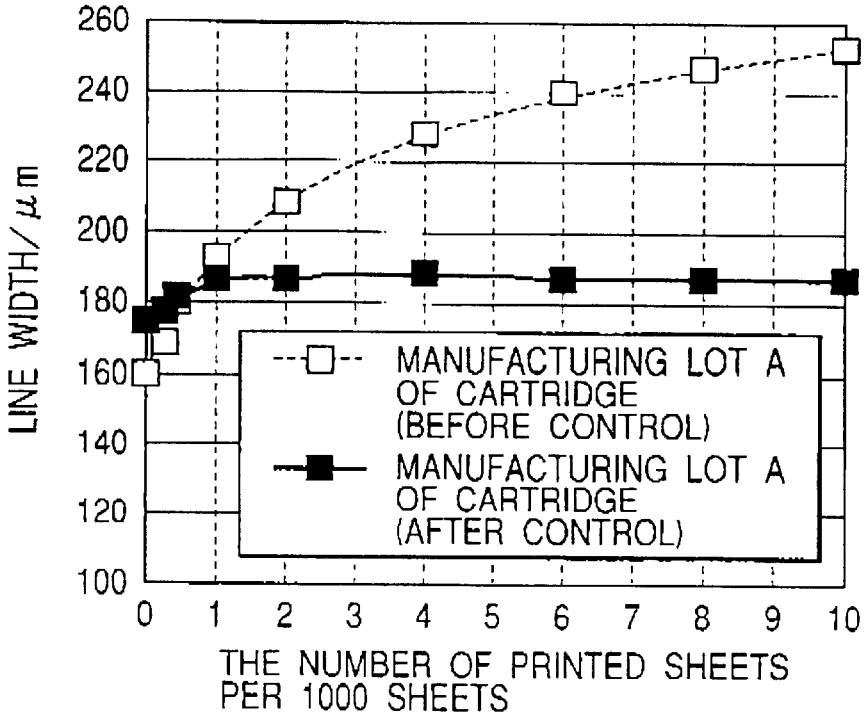
FIG. 10 is a graph showing the endurance transition of the line width before and after the control of the setting of potential according to the present invention.

FIG. 10 shows the endurance transition of the line width in the cartridge of the manufacturing lot A, and the comparison between a case where use was made of the control of the potential setting shown in the above-described flow charts and a case where use was not made of such control. As compared with the endurance fluctuation of the line width before the control, the endurance fluctuation of the line width after the control is greatly suppressed. In this manner, the uneven manufacture and endurance fluctuation of cartridges can be prevented with respect to the line width. Also, while in the embodiment, attention has been paid to the line width, this also holds true of other graphic images or the like.

As described above, by controlling the potential setting in conformity with the individual condition of the process cartridge and the used amount of the photosensitive drum 3, it has become possible to provide stable images from the early stage till the end of the use of the process cartridge by a simple and inexpensive construction.

Also, by carrying means for storing the used amount therein on the process cartridge, even when another process cartridge is temporarily used in the course of use, the adjustment of the quality of image with regard to the line width can be effected in conformity with the cartridge used.

Further, while the present embodiment has been described with respect to a case where use is made of a process cartridge into which the photosensitive drum 3, the charging roller, the developing apparatus and the cleaning means are integrally made, of course there is also an equal effect in an image forming apparatus wherein a photosensitive body is singly interchanged as an expendable element. While in the present embodiment, a description has been provided of an example of the image forming apparatus of which the operation is changed during the changeover of image resolution, it is of course also possible to equally apply the present invention to a case where the operating speed for the fixing of OHT film or thick paper is decelerated or a case where the operating speed is accelerated for the cleaning of the transferring roller or the like.

Embodiment 2

A second embodiment of the present invention will now be described.

In the second embodiment, the present invention is applied to a full color image forming apparatus of the intermediate transfer type having a plurality of process cartridges.

The driving time of a photosensitive drum 3, the charging voltage applying time and the voltage applying time of an intermediate transferring body were stored as history information in the storing means of the process cartridge, and a calculation coefficient used during the calculation of the used amount of the drum and the conversion table of process conditions and in addition thereto, the color information of toners were stored as individual information. The laser exposure amount was used as a process condition to be controlled.

As a full color image forming apparatus, there is one which has process cartridges using four colors. i.e., yellow Y, magenta M, cyan C and black K and in which a toner image is formed on each photosensitive drum 3 on the basis of image data resolved into each color, and the transfer of the toner images onto an intermediate transferring body is repeated and the toner images superimposed one upon another on the intermediate transferring body are collectively transferred to a transferring material such as paper. In the case of such an image forming apparatus, the developing property differs among the colors and thus, the endurance change of the image characteristic such as the line width differs among the respective color process cartridges. Also, the charging voltage and transferring voltage to the photosensitive drum 3 and the sequence differ for each color, and it is necessary to calculate the used amount of the photosensitive drum 3 for each color.

In the case of such an image forming apparatus, a conversion table for the used amount of the photosensitive drum 3 and a proper laser exposure amount is provided for each process cartridge, and each time the process cartridge is changed over, the laser exposure amount is changed, whereby the line width of each color can be uniformized and yet the endurance fluctuation can be mitigated.

It is to be understood that the form of my invention herein shown and described is to be taken as a preferred example of the same and that various changes in the shape size and arrangement of parts may be resorted to without departing from the spirit of my invention or the scope of the subjoined claims.

What is claimed is:

1. An electrophotographic image forming apparatus to which is detachably attachable a process cartridge to be mounted thereon and for forming an image on a recording medium, comprising:

mounting means for detachably mounting the process cartridge having an electrophotographic photosensitive body, a part of process means for acting on said electrophotographic photosensitive body, and storing means for storing information, wherein the process means includes charging means for uniformly charging the surface of the electrophotographic photosensitive body and developing means for developing a latent image on the electrophotographic photosensitive body;

driving means for driving the electrophotographic photosensitive body at a plurality of speeds;

read and write means for reading the information out from or writing the information into the storing means; and control means for controlling an operating condition of the process means;

wherein the storing means stores information relating to the utilized amount of the electrophotographic photosensitive body and calculation coefficient information for calculating the utilized amount of the electrophotographic photosensitive body according to the speed of the electrophotographic photosensitive body, and wherein said control means effects a calculation of the utilized amount of the electrophotographic photosensitive body according to the information relating to the utilized amount of the electrophotographic photosensitive body stored in the storing means and the calculation coefficient information and changes the operating condition according to a result of the calculation.

2. A electrophotographic image formign apparatus according to claim 1, wherein the storing means has individual information regarding manufacturing lots or the kinds of at least one of the process cartridge, a developer, the electrophotographic photosensitive body, the process means for acting on the electrophotographic photosensitive body, and a functional member included in the process means.

3. An electrophotographic image forming apparatus according to claim 1, further comprising changing means for changing the applied voltage for the charging means when an image is formed.

4. An electrophotographic image forming apparatus according to claim 1, further comprising:

transferring means for transferring an image on the electrophotographic photosensitive body onto the recording medium; and changing means for changing the applied voltage for said transferring means when an image is formed.

5. An electrophotographic image forming apparatus according to claim 1, further comprising:

transferring means for transferring an image on the electrophotographic photosensitive body onto the recording medium; wherein the information stored in the storing means relating to the utilized amount of the electrophotographic photosensitive body is at least one of a total driving time of the electrophotographic photosensitive body, a total charging time applied to the electrophotographic photosensitive body, and a total transferring time of said transferring means.

6. An electrophotographic image forming apparatus according to claim 1, further comprising:

transferring means for transferring an image on the electrophotographic photosensitive body onto the recording medium, wherein the information stored in the storing means relating to the utilized amount of the electrophotographic photosensitive body is at least one of a driving time per each rotation speed of the electrophotographic photosensitive body, a charging time under each changed charging voltage condition of the charging means and a transferring time under each changed transferring voltage condition of said transferring means.

7. An electrophotographic image forming apparatus according to claim 1, wherein said control means changes an applied voltage for the charging means and an applied voltage for the developing means according to a result of the calculation.

8. An electrophotographic image forming apparatus according to claim 1, further comprising means for calculating the utilized amount of the electrophotographic photosensitive body by the following calculation expression:

$$T=k1\times t1+k2\times t2+k3\times t3+k1'\times t1'+k2'\times t2'+\ldots+\alpha$$

(where k1, k1', . . . , k2, k2', . . . , k3, k3', . . . ≧0), wherein k1, k1', k1", . . . , k2, k2', k2", . . . , k3, k3', k3", . . . , α are the calculation coefficient information, wherein t1, t1', t1", . . . , respectively represents a driving time of the electrophotographic photosensitive body, wherein t2, t2', t2", . . . , respectively represents a charging voltage applying time under respective charging voltage conditions, and wherein t3, t3', t3", . . . , respectively represents a transferring voltage applying time under respective transferring voltage conditions.

9. An electrophotographic image forming apparatus according to claim 1, wherein the storing means stores a conversion table for converting the value of the calculation into the operating condition of the process means.

10. An electrophotographic image forming apparatus according to claim 1, wherein the process cartridge comprises a cartridge in which at least one of the charging means, the developing means and cleaning means for cleaning developer on the electrophotographic photosensitive body, and the electrophotographic photosensitive body are in the cartridge together.

11. An electrophotographic image forming apparatus for forming an image on a recording medium, comprising:

an electrophotographic photosensitive body;

process means for acting on said electrophotographic photosensitive body, said process means including charging means for uniformly charging the surface of said electrophotographic photosensitive body and developing means for developing the latent image on said electrophotographic photosensitive body;

storing means for storing information;

driving means for driving said electrophotographic photosensitive body at a plurality of speeds;

read and write means for reading information out from or writing information into said storing means; and control means for controlling an operating condition of said process means, wherein said storing means stores information relating to the utilized amount of said electrophotographic photosensitive body and calculation coefficient information for calculating the utilized amount of said electrophotographic photosensitive body according to the speed of said electrophotographic photosensitive body, and wherein said control means effects a calculation of the utilized amount of said electrophotographic photosensitive body according to the information relating to the utilized amount of said electrophotographic photosensitive body stored in said storing means and the calculation coefficient information and changes the operating condition according to a result of the calculation.

12. An electrophotographic image forming apparatus according to claim 11, wherein said storing means has individual information regarding manufacturing lots or the kinds of at least one of a process cartridge, a developer, said electrophotographic photosensitive body, said process means for acting on said electrophotographic photosensitive body, and a functional member included in said process means.

13. An electrophotographic image forming apparatus according to claim 11, further comprising changing means for changing an applied voltage for said charging means when an image is formed.

14. An electrophotographic image forming apparatus according to claim 11, further comprising:

transferring means for transferring an image on the electrophotographic photosensitive body onto the recording medium; and changing means for changing an applied voltage for said transferring means when an image is formed.

15. An electrophotographic image forming apparatus according to claim 11, further comprising transferring means for transferring an image on the electrophotographic photosensitive body onto the recording medium;

wherein the information stored in said storing means relating to the utilized amount of said electrophotographic photosensitive body is at least one of a total driving time of said electrophotographic photosensitive body, a total charging time, and a total transferring time applied to said electrophotographic photosensitive body of said transferring means.

16. An electrophotographic image forming apparatus according to claim 11, further comprising transferring means for transferring an image on the electrophotographic photosensitive body onto the recording medium;

wherein the information stored in said storing means relating to the utilized amount of said electrophotographic photosensitive body is at least one of a driving time per each rotation speed of said electrophotographic photosensitive body, a charging time under each changed charging voltage condition of the charging means, and a transferring time under each changed transferring voltage condition of the transferring means.

17. An electrophotographic image forming apparatus according to claim 11, wherein said control means changes an applied voltage for said charging means and an applied voltage for said developing means according to a result of the calculation.

18. An electrophotographic image forming apparatus according to claim 11, further comprising means for calculating the utilized amount of said electrophotographic photosensitive body by the following calculation expression:

$$T=k1\times t1+k2\times t2+k3\times t3+k1'\times t1'+k2'\times t2'+\ldots+\alpha$$

(where k1, k1', . . . , k2, k2', . . . , k3, k3', . . . ≧0), wherein k1, k1', k1", . . . , k2, k2', k2", . . . , k3, k3', k3", . . . , α are the calculation coefficient information;

wherein t1, t1', t1", . . . , respectively represents a driving time of said electrophotographic photosensitive body, wherein t2, t2', t2", . . . , respectively represents a charging voltage applying time under respective charging voltage conditions, and wherein t3, t3', t3", . . . , respectively represents a transferring voltage applying time under respective transferring voltage conditions.

19. An electrophotographic image forming apparatus according to claim 11, wherein said storing means stores a conversion table for converting the value of the calculation into the operating condition of said process means.

20. A process cartridge detachably attachable to the main body of an electrophotographic image forming apparatus, the electrophotographic image forming apparatus including an electrophotographic photosensitive body, process means for acting on the electrophotographic photosensitive body and including one of charging means for charging the electrophotographic photosensitive body, developing means for developing a latent image formed on the electrophotographic photosensitive body, and cleaning means for cleaning the electrophotographic photosensitive body, and driving means for driving the electrophotographic photosensitive body at a plurality of speeds, said process cartridge comprising:

said electrophotographic photosensitive body; and storing means having a first memory area configured to store information relating to a utilized amount of said electrophotographic photosensitive body and a second memory area configured to store calculation coefficient information for calculating a utilized amount of said electrophotographic photosensitive body according to a rotation speed of said electrophotographic photosensitive body.

21. A process cartridge according to claim 20, wherein said storing means has an area configured to store individual information regarding manufacturing lots or the kinds of at least one of said process cartridge, a developer, said electrophotographic photosensitive body, the process means for acting on said electrophotographic photosensitive body, and a functional member included in the process means.

22. A process cartridge according to claim 20, wherein the image forming apparatus further comprises transferring means for transferring an image on said electrophotographic photosensitive body onto a recording medium, wherein the information stored in said storing means relating to a utilized amount of said electrophotographic photosensitive body is at least one of a total driving time of said electrophotographic photosensitive body, a total charging time applied to said electrophotographic photosensitive body, and a total transferring time of said transferring means.

23. A process cartridge according to claim 20, wherein the image forming apparatus further comprises transferring means for transferring an image on said electrophotographic photosensitive body onto a recording medium, and wherein the information stored in said storing means relating to a utilized amount of said electrophotographic photosensitive body is at least one of a driving time of said electrophotographic photosensitive body at each changed surface moving speed, a charging time under each changed charging voltage condition of the charging means, and a transferring time under each changed transferring voltage condition of said transferring means.

24. A process cartridge according to claim 20, wherein the image forming apparatus comprises control means for calculating a utilized amount of said electrophotographic photosensitive body according to the information stored in said storing means relating to a utilized amount of said electrophotographic photosensitive body and the calculation coefficient information, and wherein said storing means includes an area configured to store a conversion table for converting the result of the calculation into an operating condition of the process means.

25. A process cartridge according to claim 24, wherein the image forming apparatus further includes means for calculating a utilized amount of said electrophotographic photosensitive body by the following calculation expression:

$$T=k1\times t1+k2\times t2+k3\times t3+k1'\times t1'+k2'\times t2'+\ldots+\alpha$$

(where k1, k1', . . . , k2, k2', . . . , k3, k3', . . . ≧0), wherein k1, k1', k1", . . . , k2, k2', k2", . . . , k3, k3', k3", . . . , α are the calculation coefficient information, wherein t1, t1', t1", . . . , respectively represents a driving time of said electrophotographic photosensitive body, wherein t2, t2', t2", . . . , respectively represents a charging voltage applying time under respective charging voltage conditions, and wherein t3, t3', t3", . . . , respectively represents a transferring voltage applying time under respective transferring voltage conditions.

26. A process cartridge according to claim 20, wherein the image forming apparatus further comprises control means for calculating a utilized amount of said electrophotographic photosensitive body according to the information stored in said storing means relating to a utilized amount of said electrophotographic photosensitive body and the calculation coefficient information, and wherein said storing means of said process cartridge has an area configured to store the utilized amount of said electrophotographic photosensitive body calculated by said control means.

27. A process cartridge according to claim 20, further comprising at least one of the charging means, the developing means and the cleaning means.

28. A memory device to be mounted on a process cartridge of an image forming apparatus, the process cartridge being detachably mountable to a main body of the image forming apparatus, the image forming apparatus including and electrophotographic photosensitive body, process means for acting on the electrophotographic photosensitive body and including one of charging means for charging the electrophotographic photosensitive body, developing means for developing a latent image formed on the electrophotographic photosensitive body, and cleaning means for cleaning the electrophotographic photosensitive body, and a driving means for driving the photosensitive body, wherein the driving means drives the photosensitive body at a plurality of speeds, said memory device comprising:

a first memory area configured to store information relating to a utilized amount of the photosensitive body; and a second memory area configured to store calculating coefficient information for calculating a utilized amount of the photosensitive body according to a rotation speed of the photosensitive body.

29. A memory device according to claim 28, wherein the process cartridge includes the photosensitive body and at least one of the charging means, the developing means and the cleaning means.

30. A memory device according to claim 28, wherein the image forming apparatus further comprises transferring means for transferring an image on said electrophotographic photosensitive body onto a recording medium, and wherein the information relating to a utilized amount of the photosensitive body is at least one of a total driving time of the photosensitive body, a total charging time applied to the photosensitive body, and a total transferring time of said transferring means.

31. A memory device according to claim 28, wherein the image forming apparatus includes control means for calculating a utilized amount of the photosensitive body according to information stored in said first memory area relating to a utilized amount of the photosensitive body and calculating coefficient information stored in said second memory area, the calculating coefficient information being used for calculating a utilized amount of the photosensitive body according to a rotation speed of the photosensitive body, and wherein said memory device further comprises a third memory area configured to store a conversion table for converting a utilized amount of the photosensitive body, calculated by the control means, into an operating condition of the process means.

32. A control system for controlling an image forming apparatus comprising a main body and a process cartridge, the image forming apparatus including an electrophotographic photosensitive body, process means for acting on the electrophotographic photosensitive body and including one of charging means for charging the electrophotographic photosensitive body, developing means for developing a latent image formed on the electrophotographic photosensitive body, and cleaning means for cleaning the electrophotographic photosensitive body, and driving means for driving the electrophotographic photosensitive body at a plurality of speeds, said control system comprising:

a memory device mounted on the process cartridge and including:

a first memory area configured to store information relating to a utilized amount of the electrophotographic photosensitive body; and a second memory area configured to store calculation coefficient information for calculating a utilized amount of the electrophotographic photosensitive body according to a rotation speed of the electrophotographic photosensitive body; and control means for effecting a calculation of a utilized amount of the electrophotographic photosensitive body according to information stored in said first memory area, and calculation coefficient information stored in said second memory area, and changing an operating condition of the developing means according to a result of the calculation.

33. A control system according to claim 32, wherein said control means changes an applied voltage for the developing means according to the result of the calculation.

34. A control system according to claim 32, wherein the process cartridge includes the photosensitive body and at least one of the charging means, the developing means, and the cleaning means.

35. A control system according to claim 32, wherein said memory device further comprises a third memory area configured to store a conversion table for converting the utilized amount of the photosensitive body of the calculation into an operating condition of the process means.

* * * * *